United States Patent [19]

Tesch

[11] Patent Number: 4,908,566

[45] Date of Patent: Mar. 13, 1990

[54] VOLTAGE REGULATOR HAVING STAGGERED POLE-ZERO COMPENSATION NETWORK

[75] Inventor: Bruce J. Tesch, Melbourne, Fla.

[73] Assignee: Harris Corporation, Melbourne, Fla.

[21] Appl. No.: 313,435

[22] Filed: Feb. 22, 1989

[51] Int. Cl.[4] ..... G05F 1/56

[52] U.S. Cl. ..... 323/280; 323/303; 330/284; 330/294

[58] Field of Search ..... 323/280, 281, 303; 330/278, 284, 291–294

[56] References Cited

U.S. PATENT DOCUMENTS

| | | | |
|---|---|---|---|
| 4,205,276 | 5/1980 | Wright et al. | 330/294 |
| 4,451,795 | 5/1984 | Kilian | 330/294 |
| 4,771,226 | 9/1988 | Jones | 323/303 |
| 4,786,854 | 11/1988 | Harada et al. | 323/280 |
| 4,792,747 | 12/1988 | Schroeder | 323/274 |

*Primary Examiner*—Peter S. Wong

*Attorney, Agent, or Firm*—Antonelli, Terry & Wands

[57] ABSTRACT

The feedback control loop of the common-emitter output transistor stage of a low dropout voltage regulator imcorporates a staggered pole-zero network, which effectively introduces an incremental reduction, or roll-off, in gain, and an accompanying reduction in phase shift with increase in frequency, so that, at the unity gain point of the transfer characteristic, there is still substantial phase margin, thus preventing the circuit from being driven into oscillation. The RC load pole location can vary widely and stability is maintained. The network is configured as a staggered resistor-capacitor network comprised of plural resistor-capacitor circuits coupled in cascade between the output of the feedback error amplifier and the input of a buffer amplifier the output of which drives the base of the output stage transistor in order to offset loading effects of the transistor base on the staggered pole-zero network.

16 Claims, 4 Drawing Sheets

VOLTAGE REGULATOR HAVING STAGGERED POLE-ZERO COMPENSATION NETWORK

FIELD OF THE INVENTION

The present invention relates in general to voltage regulator circuits and is particularly directed to a passive compensation network for controlling the regulator's gain and phase shift characteristics, such that the regulator output is unconditionally stable over a wide frequency range and is therefore capable of driving loads, the resistance and capacitance values of which are subject to large variations.

BACKGROUND OF THE INVENTION

FIG. 1 diagrammatically illustrates the typical configuration of the output stage of a low dropout voltage regulator, which employs a common emitter-configured transistor in the output stage and thus allows the output-input voltage differential to be minimized at $V_{CESAT}$ (typically on the order of 0.5 volts). Specifically, the output stage is comprised of a common emitter-configured transistor 10, the emitter 11 of which is coupled to an input voltage terminal 20, to which an input voltage $V_{in}$ is applied. It's collector 13 is coupled to an output voltage terminal 30 from which a regulated output voltage $V_{out}$ is to be produced, and its base 12 is coupled to the output of an error amplifier 40. A first (non-inverting) input 41 of error amplifier 40 is coupled to output terminal 30 and is compared with a reference voltage 50 that is applied to a second (inverting) input 42 of amplifier 40. Error amplifier 40 serves to provide a feedback base drive to transistor 10 and thereby regulates the output voltage at output terminal 30.

As schematically illustrated in FIG. 1, the load 60 to which regulated voltage output terminal 30 is coupled is typically in the form of a (parallel) resistor-capacitor circuit, shown as having a resistor 61 and a capacitor 62 coupled between terminal 30 and a reference node (e.g. ground). Analysis of the transistor function of the circuit configuration of FIG. 1 reveals that the dominant pole is normally that of the RG load 60. With a typical value of resistor 61 on the order of 5 ohms and that of capacitor 62 on the order of 22 $\mu$F, the resulting pole occurs at approximately 1 KHz, which is sufficently low to effectively assure closed loop stability of the system. However, as load parameters are substantially reduced, the location of the dominant pole is subject to a dramatic increase in frequency, which can result in a modification of the transfer function that the circuit goes into oscillation.

More particularly, the emphasis on increase in component integration density of microelectronic circuits has led to replacement of distributed power supply components by a single high power device that must be capable of meeting high output current (low output resistance) requirements. This significant (e.g. an order of magnitude) reduction in output resistance $R_L$ must be offset by a corresponding increase in load capacitance $C_L$ in order to maintain circuit stability. However, because of size constraints, the incorporation of a large valued capacitor is not practically feasible. Moreover, it may even be the case that the load capacitance is also reduced, thereby forcing the RC load pole to a frequency several orders of magnitude greater than the 1 KHz value, so that over a substantial portion of the operational frequency range, error amplifier 40 provides positive feedback, thus driving the output stage into oscillation.

SUMMARY OF THE INVENTION

In accordance with the present invention, the feedback control loop of the emitter follower output transistor stage is modified to incorporate a staggered pole-zero network which effectively introduces an incremental reduction or rolloff in gain, and an accompanying reduction in phase shift with increase in frequency, so that at the unity gain point of the transfer characteristic there is still a substantial phase margin, thus preventing the circuit from being driven into oscillation. For this purpose, the present invention employs a staggered resistor-capacitor network comprised of plural resistor-capacitor circuits coupled in cascade between the output of the feedback error amplifier and the base of the output stage common emitter transistor. A buffer amplifier is coupled between the compensation network and the base of the output stage transistor in order to offset loading effects of the staggered compensation network in the output of the error amplifier. Each pole-zero increment of the compensation network is comprised of series connected first and second resistors and a capacitor. The first resistor is connected between an input node and an output node, while the second resistor and the capacitor are connected in series between the output node and a reference node (ground). The first resistors of the cascaded compensation networks are connected in series between the output of the error amplifier and the base drive buffer for the output transistor, so that the input/output nodes of the respective RC stages of the compensation network are coupled in series. The values of the capacitors of successive stages of the network are chosen such that attenuation occurs with less than 90 degrees of phase shift, so that unconditional stability will be maintained even when the $R_{load}C_{load}$ pole occurs at much lower frequencies.

DETAILED DESCRIPTION

Figure 1:
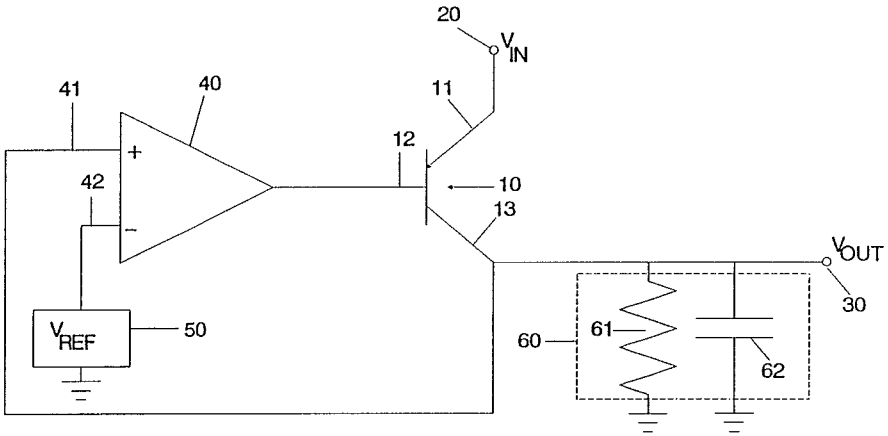
FIG. 1 (PRIOR ART)
FIG. 1 diagrammatically illustrates the configuration of the output stage of a conventional low dropout voltage regulator, employing a common emitter-configured transistor in the output stage.
Figure 2:
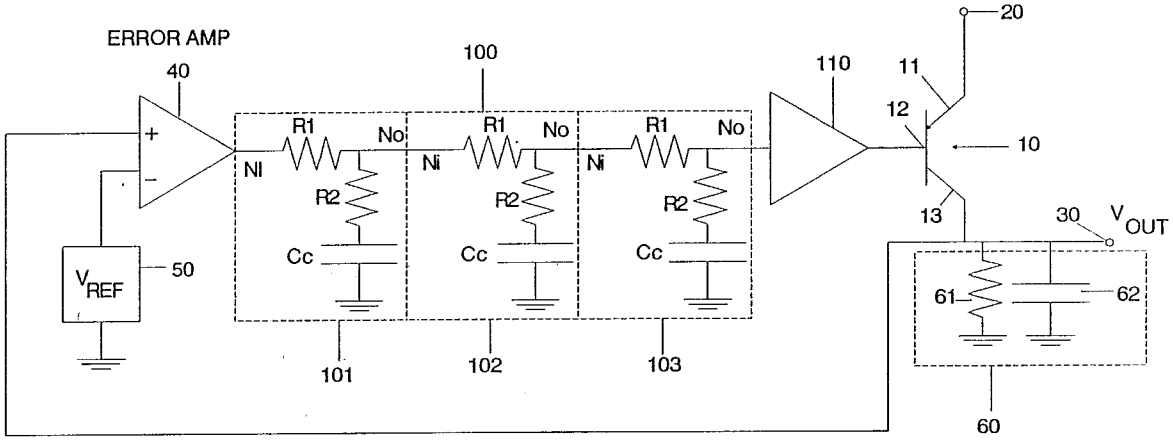
FIG. 2 diagrammatically illustrates an embodiment of a voltage regulator incorporating a staggered pole - zero compensation network in accordance with the present invention.

Referring now to FIG. 2, an embodiment of a voltage regulator incorporating a staggered pole-zero compensation network in accordance with the present invention is diagrammatically illustrated as including the same components of the conventional configuration shown in FIG. 1, described supra, but modified to include a multiple resistor-capacitor compensation network 100 and an associated buffer amplifier 110, coupled in cascade between the output of error amp 40 and the base of transistor 10. Compensation network 100 is depicted as containing a plurality (three in the illustrated non-limitative example) of resistor-capacitor circuit is 101, 102 and 103, coupled in cascade between the output of feedback error amplifier 40 and the input of buffer amplifier 110. Buffer amplifier 110 serves to offset loading effects of the base of transistor 10 on the staggered pole-zero network 100. Each pole-zero circuit portion 101, 102 and 103 of compensation network 100 is comprised of series connected first and second resistors R1, R2 and a capacitor Cc. The first resistor R1 is connected between an input node Ni and an output node No, while the second resistor R2 and the capacitor Cc are connected in series between a respective output node No and a reference node Nr (e.g. ground). The first resistors R1 of the cascaded compensation networks 101, 102 and 103 are connected in series between the output of error amplifier 40 and the base drive buffer 110 for output transistor 10, so that the input/output nodes Ni, No of the respective stages 101, 102 and 103 of compensation network 100 are resistively coupled in series. The values of the capacitors Cc of the successive stages of network 100 may be reduced, for example, in multiples of a decade (e.g. 1 microfarad, 0.03 microfarads and 0.001 microfarads), so that the poles of the transfer function of the closed loop circuit, including transistor 10, its output RC load and the base drive feedback network (including the compensation RC components), it will be spread out over decades of frequency and thereby provide an incremental gain attenuation function over a substantial bandwidth with less than 90 degrees of phase shift.

Figure 3:
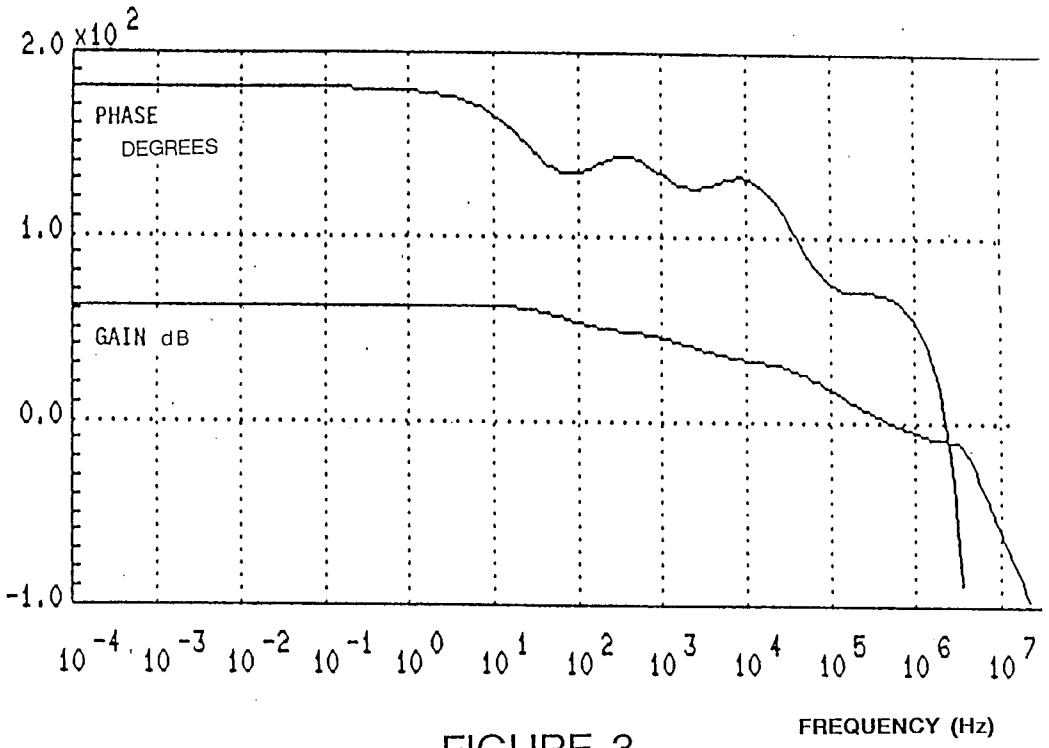
FIG. 3 shows the variation with frequency of gain and phase shift of the output stage of the circuit configuration of FIG. 2 for relatively small valued $R_LC_L$ loads (high frequency $R_LC_L$ pole)
Figure 4:
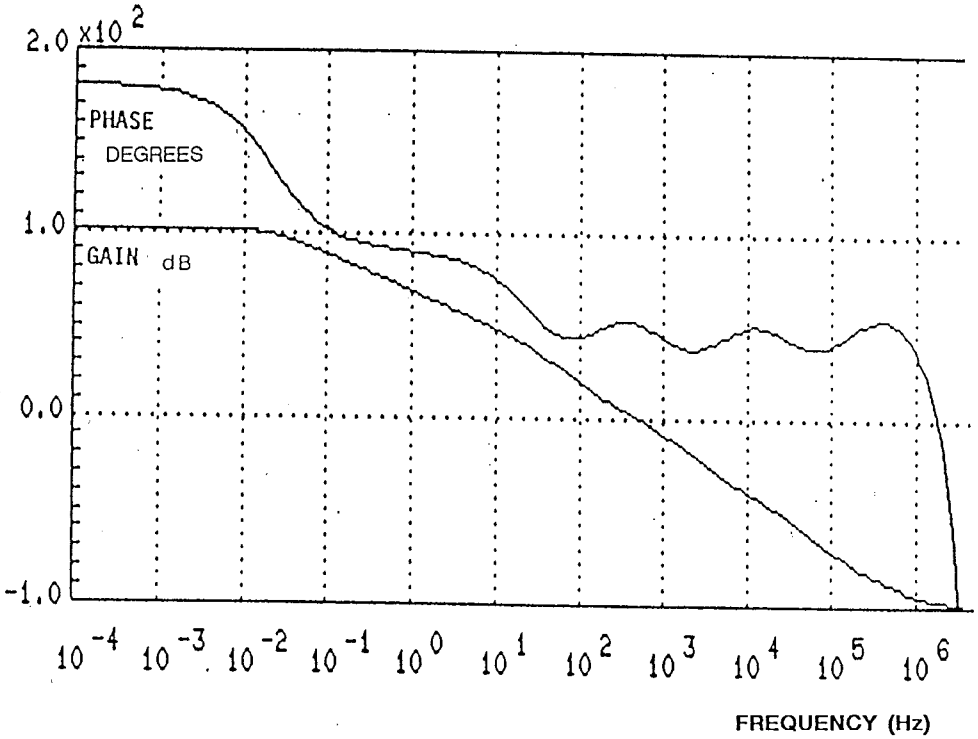
FIG. 4 shows the variation with frequency of gain and phase shift of the output stage of the circuit configuration of FIG. 2 for relatively large valued $R_LC_L$ loads (low frequency $R_LC_L$ pole).

Analysis of the transfer function of FIG. 2 reveals that, unlike the pole introduced by RC load 60 which, for very small valued components, may be located at an extremely high frequency (which might otherwise cause the circuit to go into oscillation), compensation network 100 causes an incremental roll-off in the gain and phase-shift characteristics (diagrammatically shown in FIGS. 3 and 4 for relatively small valued $R_LC_L$ loads (high frequency $R_LC_L$ pole) and relatively large valued $R_LC_L$ loads (low frequency $R_LC_L$ pole), respectively, so that, at the unity gain point of the transfer characteristic there is still a substantial phase margin (e.g. in a range on the order of 45–60 degrees), thus preventing the circuit from being driven into oscillation, regardless of the increased RC load pole frequency.

While I have shown and described an embodiment in accordance with the present invention, it is to be understood that the same is not limited thereto but is susceptible to numerous changes and modifications as known to a person skilled in the art, and I therefore do not wish to be limited to the details shown and described herein but intend to cover all such changes and modifications as are obvious to one of ordinary skill in the art.

What is claimed:

1. A voltage regulator circuit comprising:

an output amplifier stage having an input terminal to which an unregulated input voltage is coupled, an output terminal from which a regulated output voltage is derived, and a control terminal to which a control voltage is applied;

an error amplifier stage having a first input coupled to said output terminal, a second input coupled to receive a reference voltage, and an output from which an error voltage representative of the difference between said regulated output voltage and said voltage is coupled as said control voltage for said output amplifier stage; and means, coupled in a feedback path from said output terminal through said error amplifier stage to said control terminal, for maintaining the open loop phase differential between the first input of said error amplifier stage and the output terminal of said output amplifier stage less than 360° for the entirety of the frequency range over which the gain is equal to or greater than unity.

2. A voltage regulator circuit according to claim 1, wherein said means comprises a resistor-capacitor network.

3. A voltage regulator circuit according to claim 1, wherein said means comprises a plurality of resistor-capacitor stages coupled in cascade between the output of said error amplifier and the control terminal of said output amplifier stage.

4. A voltage regulator circuit according to claim 3, wherein each resistor-capacitor stage comprises an input node, an output node and a reference voltage node, and includes a first resistor coupled between said input and output nodes and a series connection of a second resistor and a capacitor coupled between said output node and said reference voltage node, and wherein said resistor-capacitor stages are cascaded such that the first resistors thereof are coupled in series between the output of said error amplifier and the control terminal of said output amplifier stage.

5. A voltage regulator circuit according to claim 4, wherein said output amplifier stage comprises a common-emitter configured bipolar transistor, the emitter of which is coupled to said unregulated input terminal, the base of which is coupled to said control terminal through a buffer stage and the collector of which is coupled to said output terminal.

6. A voltage regulator circuit according to claim 4, wherein the values of the capacitors of respective ones of said resistor-capacitor stages are different from one another.

7. A method of maintaining stable operation of a voltage regulator circuit which comprises an output amplifier stage having an input terminal to which an unregulated input voltage is coupled, an output terminal from which a regulated output voltage is derived for application to an output load, and a control terminal to which a control voltage is applied; and an error amplifier stage having a first input coupled to said output terminal, a second input coupled to receive a reference voltage, and an output from which an error voltage representative of the difference between said regulated output voltage and said reference voltage is coupled as said control voltage for said output amplifier stage;

said method maintaining stable operation of said regulator circuit over the entirety of the frequency range over which gain is equal to or greater than unity, irrespective of the pole-zero characteristics of the output load, comprising the steps of:

providing a staggered hole-zero compensation network in a feedback path from said output terminal through said error amplifier stage to said control terminal.

8. A method according to claim 7, wherein said step comprises coupling a plurality of resistor-capacitor stages in cascade between the output of said error amplifier and the control terminal of said output amplifier stage.

9. A method according to claim 8, wherein each resistor-capacitor stage comprises an input node, an output node and a reference voltage node, and includes a first resistor coupled between said input and output nodes and a series connection of a second resistor and a capacitor coupled between said output node and said reference voltage node, and wherein said resistor capacitor stages are cascaded such that the first resistors thereof are coupled in series between the output of said error amplifier and the control terminal of said output amplifier stage.

10. A method according to claim 9, wherein said output amplifier stage comprises a common-emitter configured bipolar transistor, the emitter of which is coupled to said unregulated input terminal, the base of which is coupled to said control terminal through a buffer stage and the collector of which is coupled to said output terminal.

11. A method according to claim 8, wherein the values of the capacitors of respective ones of said resistor-capacitor stages are different from one another.

12. A voltage regulator circuit comprising:

an output amplifier stage having an input terminal to which an unregulated input voltage is coupled, an output terminal from which a regulated output voltage is derived for application to an output load, and a control terminal to which a control voltage is applied;

an error amplifier stage having a first input coupled to said output terminal, a second input coupled to receive a reference voltage, and an output from which an error voltage representative of the difference between said regulated output voltage and said reference voltage is coupled as said control voltage for said output amplifier stage; and means for maintaining stable operation of said regulator circuit over the entirety of the frequency range over which gain is equal to or greater than unity irrespective of the pole-zero characteristics of the output load, said means comprising a staggered pole-zero compensation network in a feedback path from said output terminal through said error amplifier stage to said control terminal.

13. A voltage regulator circuit according to claim 12, wherein said pole-zero compensation network comprises a plurality of resistor-capacitor stages coupled in cascade between the output of said error amplifier and the control terminal of said output amplifier stage.

14. A voltage regulator circuit according to claim 13, wherein each resistor-capacitor stage comprises an input node, an output node and a reference voltage node, and includes a first resistor coupled between said input and output nodes and a series connection of a second resistor and a capacitor coupled between said output node and said reference voltage node, and wherein said resistor capacitor stages are cascaded such that the first resistors thereof are coupled in series between the output of said error amplifier and the control terminal of said output amplifier stage.

15. A voltage regulator circuit according to claim 14, wherein said output amplifier stage comprises a common-emitter configured bipolar transistor, the emitter of which is coupled to said unregulated input terminal, the base of which is coupled to said control terminal through a buffer stage and the collector of which is coupled to said output terminal.

16. A voltage regulator circuit according to claim 13, wherein the values of the capacitors of respective ones of said resistor-capacitor stages are different from one another.

* * * * *